US010286650B2

(12) United States Patent
Kitai et al.

(10) Patent No.: US 10,286,650 B2
(45) Date of Patent: May 14, 2019

(54) IMAGE PROCESSING APPARATUS AND IMAGE PROCESSING METHOD

(71) Applicant: CANON KABUSHIKI KAISHA, Tokyo (JP)

(72) Inventors: Satoshi Kitai, Kawasaki (JP); Masahiko Umezawa, Kawasaki (JP); Yoshiaki Murayama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/669,632

(22) Filed: Aug. 4, 2017

(65) Prior Publication Data

US 2018/0043682 A1 Feb. 15, 2018

(30) Foreign Application Priority Data

Aug. 9, 2016 (JP) ..... 2016-156868

(51) Int. Cl.
*B41J 2/21* (2006.01)
*B41J 2/045* (2006.01)

(52) U.S. Cl.
CPC ..... *B41J 2/04508* (2013.01); *B41J 2/2139* (2013.01); *B41J 2/04586* (2013.01); *B41J 2/2146* (2013.01)

(58) Field of Classification Search
CPC .... B41J 2/04508; B41J 2/2139; B41J 2/2146; B41J 2/04586
See application file for complete search history.

(56) References Cited

U.S. PATENT DOCUMENTS 6,273,542 B1 * 8/2001 Couwenhoven ..... B41J 29/393 347/19
2004/0119766 A1 * 6/2004 Shibata ..... B41J 2/2139 347/12
2011/0234676 A1 * 9/2011 Nishikawa ..... B41J 2/16579 347/19

FOREIGN PATENT DOCUMENTS

JP 2005-96424 A 4/2005

* cited by examiner

*Primary Examiner* — Yaovi M Ameh
(74) *Attorney, Agent, or Firm* — Canon U.S.A., Inc. I.P. Division

(57) ABSTRACT

A pixel row in an arrangement direction or an orthogonal direction is divided into processing groups including pixels at every predetermined pixel count in the pixel row. Non-discharge complementary processing is sequentially performed on the divided plurality of processing groups.

9 Claims, 14 Drawing Sheets

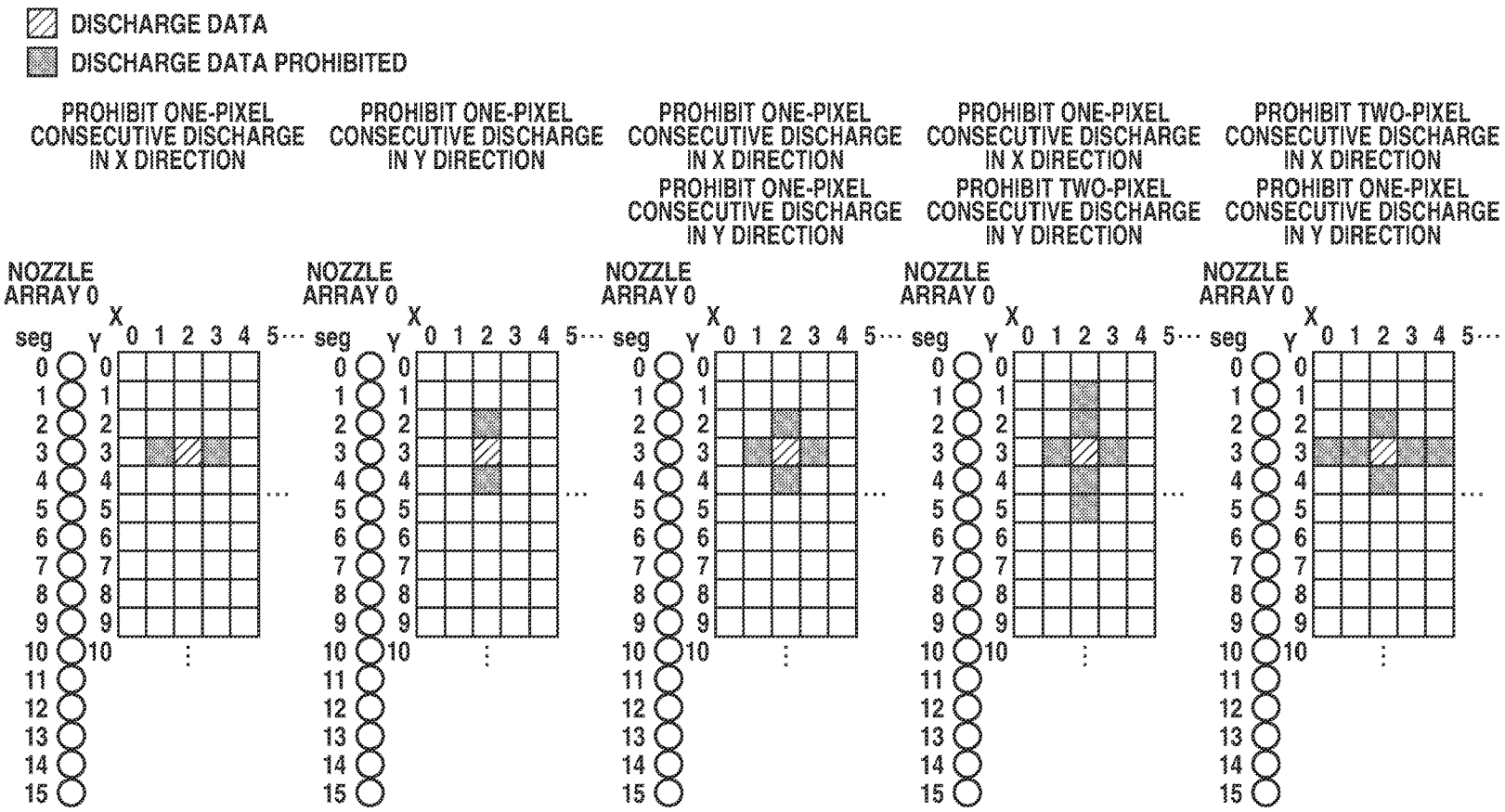
DISCHARGE DATA
DISCHARGE DATA PROHIBITED
FIG.5A
PROHIBIT ONE-PIXEL CONSECUTIVE DISCHARGE IN X DIRECTION
FIG.5B
PROHIBIT ONE-PIXEL CONSECUTIVE DISCHARGE IN Y DIRECTION
FIG.5C
PROHIBIT ONE-PIXEL CONSECUTIVE DISCHARGE IN X DIRECTION
PROHIBIT ONE-PIXEL CONSECUTIVE DISCHARGE IN Y DIRECTION
FIG.5D
PROHIBIT ONE-PIXEL CONSECUTIVE DISCHARGE IN X DIRECTION
PROHIBIT TWO-PIXEL CONSECUTIVE DISCHARGE IN Y DIRECTION
FIG.5E
PROHIBIT TWO-PIXEL CONSECUTIVE DISCHARGE IN X DIRECTION
PROHIBIT ONE-PIXEL CONSECUTIVE DISCHARGE IN Y DIRECTION
NOZZLE ARRAY 0
seg
X
Y

FIG.7A

NORMAL NOZZLE

NONDISCHARGE NOZZLE

| NOZZLE ARRAY / seg | 0 | 1 | 2 | 3 | 4 | 5 | 6 | 7 |
|---|---|---|---|---|---|---|---|---|
| 0 | | | | | | | X | |
| 1 | | | X | X | | X | | X |
| 2 | | X | | | X | | | |
| 3 | | | | | | | | |
| 4 | | X | | | | X | | |
| 5 | | | X | X | | | | |
| 6 | | | | | | | | |
| 7 | | X | | | | X | | |
| 8 | X | | | | X | | | |
| 9 | | | | | | | | |
| 10 | | | | | | | | |
| 11 | | X | | | | | | |
| 12 | | X | | | | | | X |
| 13 | | | | | | | X | |
| 14 | | | | X | | | | |
| 15 | | X | | | | | | |

FIG.7B

| NOZZLE ARRAY / seg | 0 | 1 | 2 | 3 | 4 | 5 | 6 | 7 |
|---|---|---|---|---|---|---|---|---|
| 0 | 5 | 6 | 7 | 0 | 1 | 2 | 3 | 4 |
| 1 | 4 | 5 | 6 | 7 | 0 | 1 | 2 | 3 |
| 2 | 3 | 4 | 5 | 6 | 7 | 0 | 1 | 2 |
| 3 | 2 | 3 | 4 | 5 | 6 | 7 | 0 | 1 |
| 4 | 1 | 2 | 3 | 4 | 5 | 6 | 7 | 0 |
| 5 | 0 | 1 | 2 | 3 | 4 | 5 | 6 | 7 |
| 6 | 7 | 0 | 1 | 2 | 3 | 4 | 5 | 6 |
| 7 | 6 | 7 | 0 | 1 | 2 | 3 | 4 | 5 |
| 8 | 5 | 6 | 7 | 0 | 1 | 2 | 3 | 4 |
| 9 | 4 | 5 | 6 | 7 | 0 | 1 | 2 | 3 |
| 10 | 3 | 4 | 5 | 6 | 7 | 0 | 1 | 2 |
| 11 | 2 | 3 | 4 | 5 | 6 | 7 | 0 | 1 |
| 12 | 1 | 2 | 3 | 4 | 5 | 6 | 7 | 0 |
| 13 | 0 | 1 | 2 | 3 | 4 | 5 | 6 | 7 |
| 14 | 7 | 0 | 1 | 2 | 3 | 4 | 5 | 6 |
| 15 | 6 | 7 | 0 | 1 | 2 | 3 | 4 | 5 |

FIG.12A

DISCHARGE DATA ON PIXELS (X2, Y0) TO (X2, Y7)

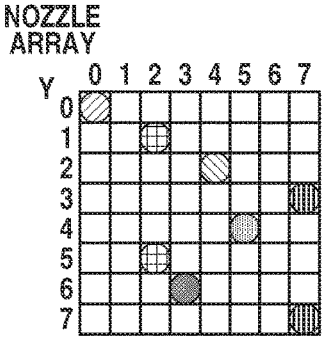

FIG.12B

NONDISCHARGE INFORMATION ABOUT NOZZLES

× NONDISCHARGE NOZZLE

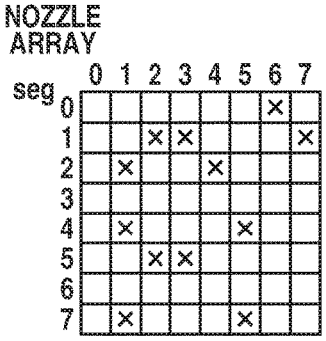

FIG.12C

PIXELS WITHOUT DISCHARGE DATA ON ADJOINING PIXELS AMONG PIXELS (X2, Y0) TO (X2, Y7)

NOZZLE WITHOUT DISCHARGE DATA IN ADJOINING PIXELS

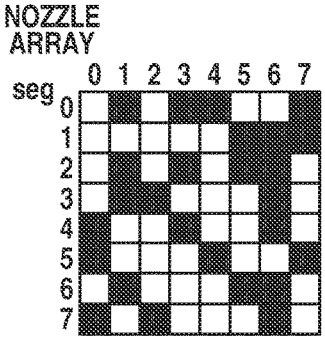

FIG.12D

PRIORITY INFORMATION TABLE

NOZZLE ARRAY

| seg | 0 | 1 | 2 | 3 | 4 | 5 | 6 | 7 |
|---|---|---|---|---|---|---|---|---|
| 0 | 5 | 6 | 7 | 0 | 1 | 2 | 3 | 4 |
| 1 | 4 | 5 | 6 | 7 | 0 | 1 | 2 | 3 |
| 2 | 3 | 4 | 5 | 6 | 7 | 0 | 1 | 2 |
| 3 | 2 | 3 | 4 | 5 | 6 | 7 | 0 | 1 |
| 4 | 1 | 2 | 3 | 4 | 5 | 6 | 7 | 0 |
| 5 | 0 | 1 | 2 | 3 | 4 | 5 | 6 | 7 |
| 6 | 7 | 0 | 1 | 2 | 3 | 4 | 5 | 6 |
| 7 | 6 | 7 | 0 | 1 | 2 | 3 | 4 | 5 |

FIG.12E

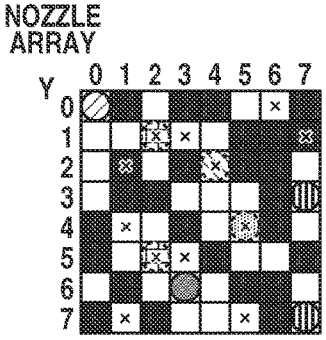

× NONDISCHARGE NOZZLE

PIXEL WITHOUT DISCHARGE DATA IN ADJOINING PIXELS

NONDISCHARGE COMPLEMENTARY TARGET PIXEL

DISCHARGE DATA

Y0, Y1, Y2, Y3, Y4, Y5, Y6, Y7
CONCURRENT PARALLEL PROCESSING

Y0, Y1, Y2, Y3, Y4, Y5, Y6, Y7
SEQUENTIAL PROCESSING

Y0, Y2, Y4, Y6
CONCURRENT PARALLEL PROCESSING
Y1, Y3, Y5, Y7
CONCURRENT PARALLEL PROCESSING

× NONDISCHARGE NOZZLE

PIXEL WITHOUT DISCHARGE DATA IN ADJOINING PIXELS

NONDISCHARGE COMPLEMENTARY TARGET PIXEL

DISCHARGE DATA

NONDISCHARGE COMPLEMENTED DATA

IMAGE PROCESSING APPARATUS AND IMAGE PROCESSING METHOD

BACKGROUND OF THE INVENTION

Field of the Invention

The present disclosure relates to one or more embodiments of an image processing apparatus and an image processing method.

Description of the Related Art

As a method of nondischarge complementation for complementing recording data of defective discharge nozzles in an inkjet recording head, for example, Japanese Patent Application Laid-Open No. 2005-96424 discusses a method for recording dots that are supposed to be recorded by discharging ink from nozzles causing a defective discharge by other nozzles nearby. In such nondischarge complementation, a nozzle is selected from a plurality of complementing candidate nozzles, and the selected nozzle discharges ink for complementation.

If a complementing nozzle is selected from a plurality of candidate nozzles, the selected nozzle and recording data desirably have a relationship such that a plurality of nozzles arranged to adjoin do not perform recording, and a single nozzle does not perform consecutive recording.

For example, the discharge frequency of ink from a recording head is increased and the conveyance speed of a recording medium is increased to increase a recording speed of an entire recording apparatus. The discharge frequency can be increased by arranging a plurality of nozzle arrays of the same type of ink in the conveyance direction. In other words, the discharge frequency can be increased in a simulative manner by the entire plurality of nozzle arrays without increasing the discharge frequency of each nozzle in a nozzle array. In such a mode, in recording an image having some area, recording data is generated so that (the nozzles of) each of the plurality of nozzle arrays is used in a distributed manner in the conveyance direction with respect to a pixel arrangement of the area. This enables recording with the simulatively high discharge frequency, i.e., high resolution recording without increasing the discharge frequency of each nozzle. In the nondischarge complementation, each nozzle array therefore needs to achieve the distributed use of nozzles in the conveyance direction by selecting candidate nozzles so that a plurality of nozzles adjoining in the conveyance direction does not discharge ink.

A nozzle array may have an issue of crosstalk between nozzles if a plurality of nozzles adjoining in its nozzle arrangement direction discharges ink. In selecting the candidate nozzle, the recording data therefore also needs to be such that a plurality of adjoining nozzles does not discharge ink.

To prevent the foregoing consecutive discharges from adjoining nozzles and consecutive discharges from a single nozzle from being caused by the nondischarge complementation, discharge data on pixel rows adjoining the pixel on which recording is performed by the nozzle to be complemented needs to be referred to. Nondischarge complementary processing on the adjoining nozzles therefore needs to be completed before the nondischarge complementary processing on the next nozzle is performed. In other words, nozzles to be complemented are sequentially processed.

In the foregoing mode in which the nozzles to be complemented are sequentially processed, the processing of one of the pixels of the nozzles to be complemented is completed before the next one is processed. This causes an issue of relatively long processing time for nondischarge complementation.

SUMMARY OF THE INVENTION

The present disclosure is directed to one or more embodiments of an image processing apparatus and an image processing method which can reduce processing time for nondischarge complementation.

According to at least one aspect of one or more embodiments of the present disclosure, an image processing apparatus configured to generate recording data used to discharge ink, by using a recording head including a nozzle array in which a plurality of nozzles configured to discharge the ink is arranged in a predetermined direction, from the recording head to a predetermined area of a recording medium while moving at least either the recording head or the recording medium in a crossing direction crossing the predetermined direction, includes a generation unit configured to generate uncomplemented data determining whether to discharge the ink from the nozzle array to each of a plurality of pixel areas on the recording medium, an obtaining unit configured to obtain information indicating a defective discharge nozzle among the plurality of nozzles, and a complementary unit configured to, if the uncomplemented data determines that the ink is discharged from a target defective discharge nozzle in the nozzle array to a target pixel area on the recording medium, complement a defective discharge of the target defective discharge nozzle by discharging the ink to any one of pixel areas ranging from one adjoining the target pixel area on the recording medium in the predetermined direction to one N pixel areas apart in the predetermined direction, wherein the complementary unit is configured to divide the plurality of pixel areas into N processing groups including pixel areas N pixel areas apart in the predetermined direction, and complement a defective discharge of a defective discharge nozzle in a sequential manner from one processing group to another.

According to other aspects of the present disclosure, one or more additional image processing apparatuses, one or more image processing methods, and one or more storage or recording mediums for use therewith are discussed herein. Further features of the present disclosure will become apparent from the following description of exemplary embodiments with reference to the attached drawings.

BRIEF DESCRIPTION OF THE DRAWINGS

FIGS. 5A, 5B, 5C, 5D, and 5E are diagrams for describing modes of discharge constraints to prohibit consecutive discharges of the recording head according to the at least one exemplary embodiment.

FIG. 7A is a diagram illustrating nondischarge information about the recording head.

FIG. 7B is a diagram illustrating priority information used in the nondischarge complementary processing according to the at least one exemplary embodiment.

FIGS. 12A, 12B, 12C, 12D, and 12E are diagrams for describing the nondischarge complementary processing performed on the nozzle array-allocated discharge data illustrated in FIG. 10, based on the presence or absence of discharge data on adjoining pixels illustrated in FIG. 11.

DESCRIPTION OF THE EMBODIMENTS

An exemplary embodiment of the present disclosure will be described in detail below with reference to the accompanying drawings.

Figure 1:
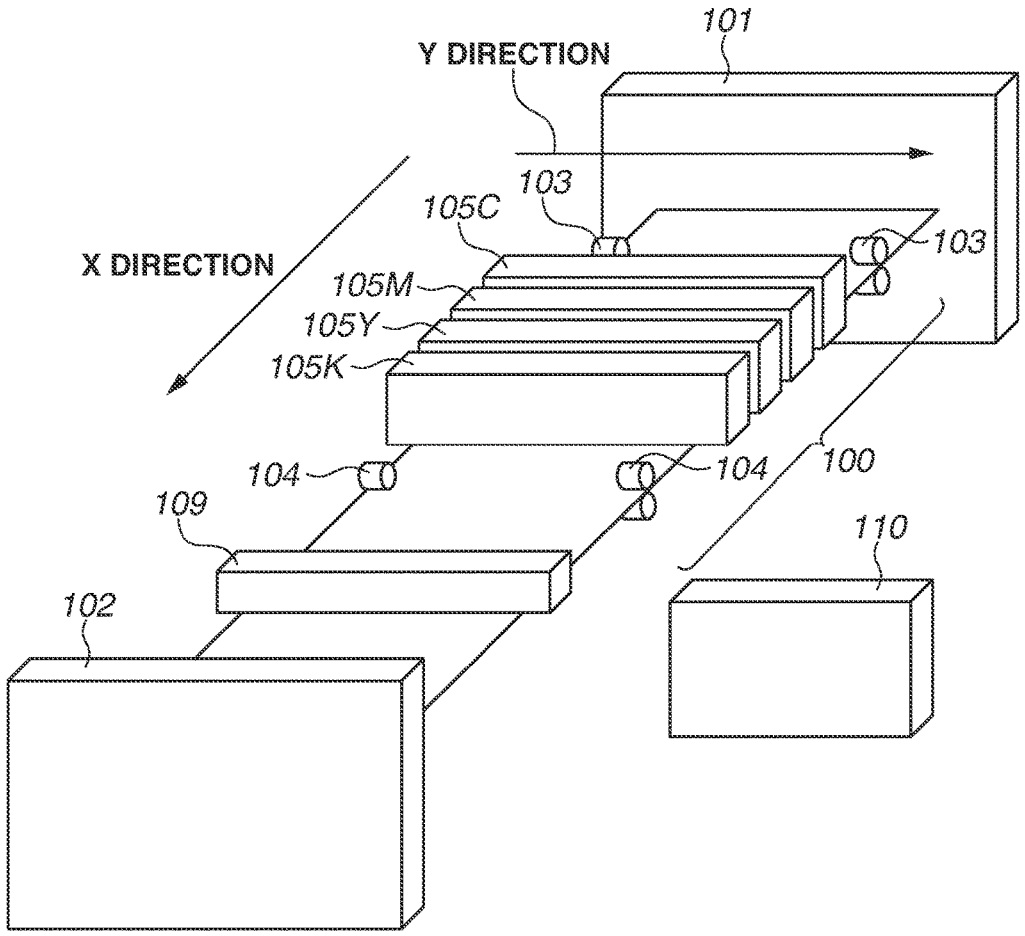
FIG. 1 is a perspective view schematically illustrating an inkjet printer according to at least one exemplary embodiment of the present disclosure.

FIG. 1 is a perspective view schematically illustrating an inkjet printer (recording apparatus) according to the at least one exemplary embodiment of the present disclosure. The inkjet printer (hereinafter, printer) according to the present exemplary embodiment uses full-line heads in which nozzles are arranged to correspond to a width of a sheet (recording medium) to be conveyed. The printer according to the present exemplary embodiment is capable of relatively fast recording, and is suited to the field of, for example, printing of a large number of sheets in a print laboratory.

As illustrated in FIG. 1, the printer according to the present exemplary embodiment includes a sheet supply unit 101, a print unit 100, a fixing unit 109, and a discharge unit 102. The sheet supply unit 101 accommodates and supplies a roll of continuous sheet serving as a recording medium.

The print unit 100 records an image on a surface of the conveyed sheet by using four recording heads 105C, 105M, 105Y, and 105K (hereinafter, may be represented by "105") which discharge ink of respective different colors. In the present exemplary embodiment, the four recording heads discharge ink of four colors cyan (C), magenta (M), yellow (Y), and black (K). The print unit 100 includes a plurality of conveyance rollers 103 and 104 for conveying the sheet on upstream and downstream sides of the recording head 105 in a sheet conveyance direction, respectively. The recording heads 105 include nozzle arrays in which nozzles for discharging ink to a range covering the maximum width of sheets assumed to be used are arranged. The nozzle arrays of the recording heads 105 include a plurality of nozzles which is arranged in a direction orthogonal to the sheet conveyance direction. As will be described below in FIG. 2, the recording head 105 of each ink color includes eight nozzle arrays. The number of ink types or ink colors and the number of recording heads are not limited to four. For example, a long recording head in which a plurality of chips including a plurality of nozzle arrays orthogonal to the sheet conveyance direction is arranged in a staggered pattern may be used. Inkjet methods that can be employed include one using heating elements, one using piezoelectric elements, one using capacitive elements, and one using microelectromechanical systems (MEMS) elements. The recording heads 105C, 105M, 105Y, and 105K are supplied with the respective color inks from not-illustrated ink tanks via respective ink tubes.

The fixing unit 109 applies hot air to the image recorded on the sheet by the inks to accelerate evaporation of moisture in the inks, thereby fixing the recorded image. The discharge unit 102 cuts the recorded sheet into a predetermined length by a not-illustrated cutter, and discharges the cut sheet. The discharge unit 102 sorts and discharges recorded sheets to not-illustrated different discharge trays group by group if needed. As will be described in detail below with reference to FIG. 3, a recording control unit 110 performs processing related to the entire printer and controls various parts. The recording control unit 110 also executes nondischarge complementary processing to be described below in FIG. 4.

Figure 2:
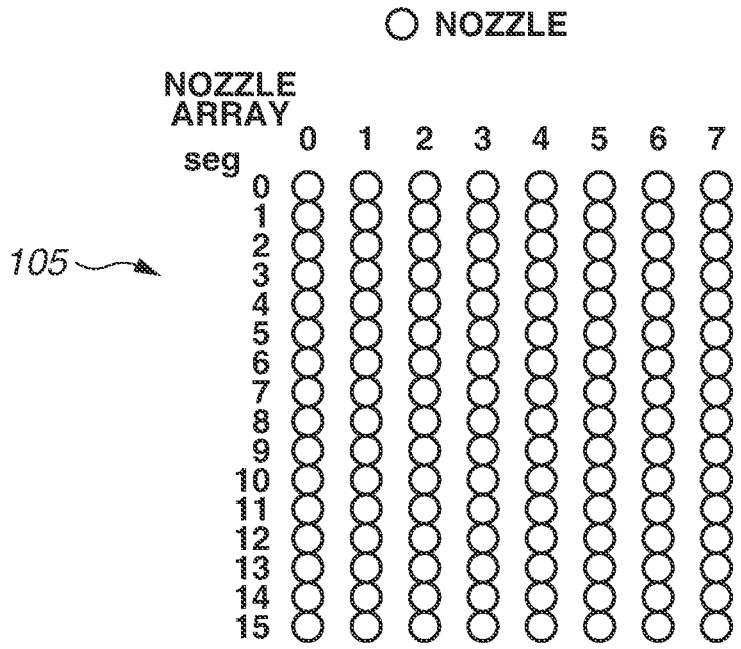
FIG. 2 is a diagram schematically illustrating a nozzle arrangement of a recording head of one type of ink according to the at least one exemplary embodiment.

FIG. 2 is a diagram schematically illustrating a nozzle arrangement of the recording head 105 of one type of ink according to the present exemplary embodiment. The recording heads 105 according to the present exemplary embodiment include eight nozzle arrays 0 to 7 for one type of ink. Each nozzle array includes 16 nozzles which are designated by seg 0 to seg 15. The number of nozzles, 16, is intended to simplify description and illustration. The nozzle arrays of the recording heads 105 used in the actual recording apparatus illustrated in FIG. 1 include an arrangement of greater numbers of nozzles which can perform recording on an area corresponding to the width of the sheet to be conveyed. As illustrated in FIG. 2, nozzles designated by the same seg number in the eight nozzle arrays are arranged so that ink can be discharged to the same position (pixel) on the conveyed sheet. As will be described below in FIG. 10, recording can be performed on a pixel row in the sheet conveyance direction in a distributed manner by a plurality of nozzles of different nozzle arrays. In the present exemplary embodiment, each of the eight nozzle arrays is driven in a time divisional manner to drive the respective nozzles for discharge. For example, the 16 nozzles in each nozzle array illustrated in FIG. 2 represent a unit in which the nozzles are driven at different timing in a time divisional manner. More specifically, driving control is performed so that the nozzles seg 0 to seg 15 are driven at respective different timings in order of seg 0 to seg 15 in succession. In such a case, adjoining nozzles, like adjoining two or three of the nozzles seg 0 to seg 15, may cause the foregoing crosstalk which can create issues depending on the degree. In the present exemplary embodiment, as will be described below in FIG. 4, discharge control is performed to prohibit a plurality of nozzles adjoining in a nozzle arrangement direction from consecutively discharging ink.

Figure 3:
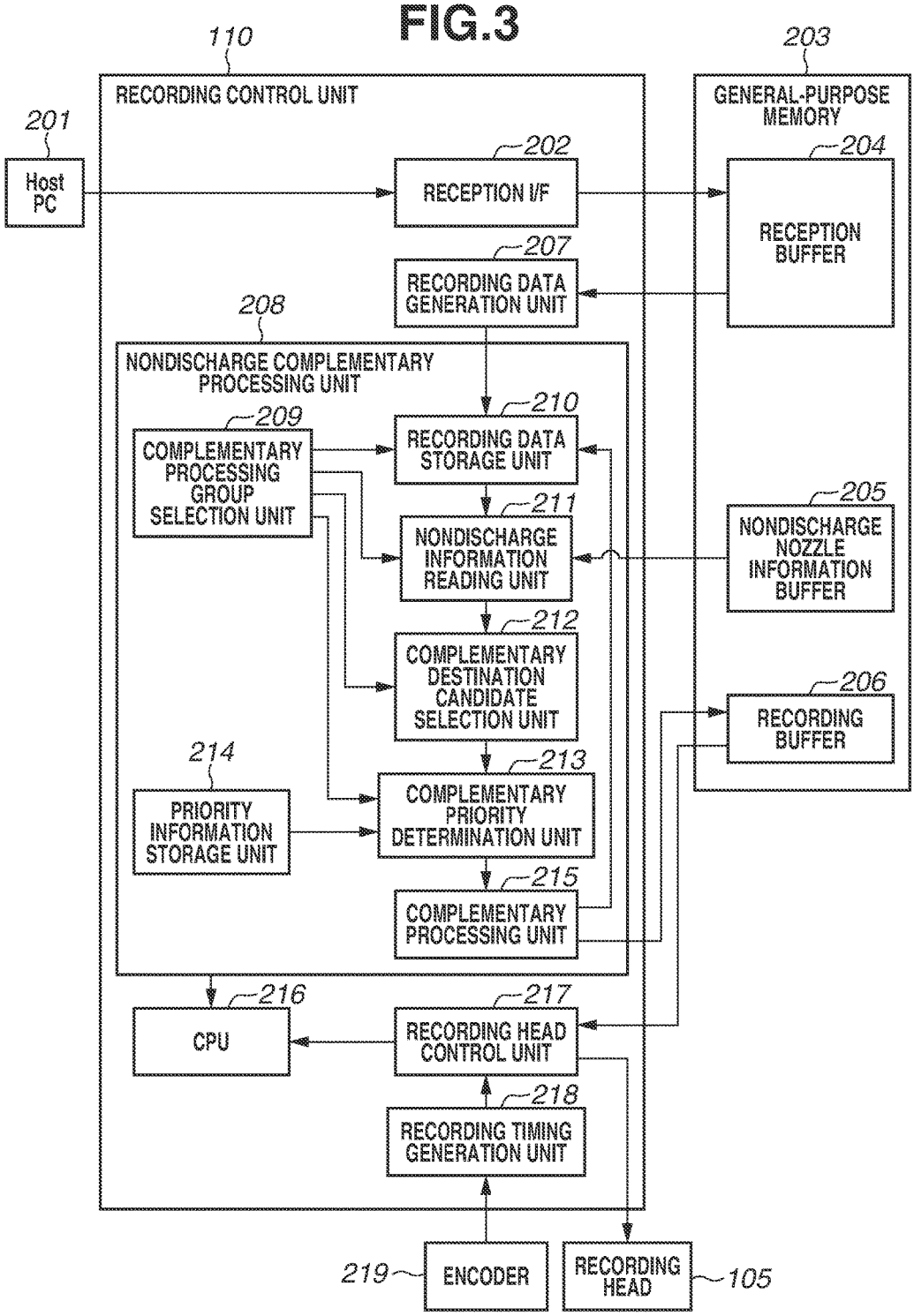
FIG. 3 is a block diagram mainly illustrating a configuration of a recording control unit illustrated in FIG. 1.

FIG. 3 is a block diagram illustrating a configuration of the recording control unit 110 illustrated in FIG. 1. The recording control unit 110 includes a memory 203 such as a dynamic random access memory (DRAM). The recording control unit 110 receives image data from a host personal computer (PC) 201 via a reception interface (I/F) 202, and stores the image data into a reception buffer 204 of a general-purpose memory 203. In the present exemplary embodiment, the image data to be received is quantized image data for each ink color. A recording data generation unit 207 reads the quantized image data from the reception buffer 204, and generates discharge data for each nozzle array in the recording head 105 of each ink color. With the eight nozzle arrays, as will be described below in FIG. 10, the recording data generation unit 207 generates discharge data for indicating either "1" (discharge) or "0" (nondischarge) for each pixel represented by (x, y) in association with the nozzle of the nozzle array to perform recording on the pixel.

A nondischarge complementary processing unit 208 performs nondischarge complementary processing on the discharge data for each nozzle array, generated by the recording data generation unit 207, based on information about nozzles that are nondischarging or causing a defective discharge. The nondischarge complementary processing unit 208 writes the resulting complemented discharge data into a recording buffer 206. The nondischarge complementary processing unit 208 includes a complementary processing group selection unit 209, a recording data storage unit 210, a nondischarge information reading unit 211, a complementary destination candidate selection unit 212, a complementary priority determination unit 213, and a complementary processing unit 215. Such units have respective functions of the nondischarge complementary processing to be described below in FIG. 4. A nondischarge nozzle information buffer 205 of the general-purpose memory 203 stores information about defective discharge nozzles corresponding to each of the eight nozzle arrays of each ink color. For example, the nozzles may be checked for a defective discharge during maintenance of the printer. The information about defective discharge nozzles can be obtained based on an input corresponding to the result of checking.

A recording head control unit 217 reads the nondischarge-complemented discharge data stored in the recording buffer 206 and transmits the discharge data of the respective ink colors to the recording heads 105. A recording timing generation unit 218 determines the amount of movement of the sheet based on a pulse signal from an encoder 219. Based on the amount of movement, the recording timing generation unit 218 generates a recording head controlling signal related to recording timing, and transmits the recording head controlling signal as a driving signal to the recording head control unit 217.

Figure 4:
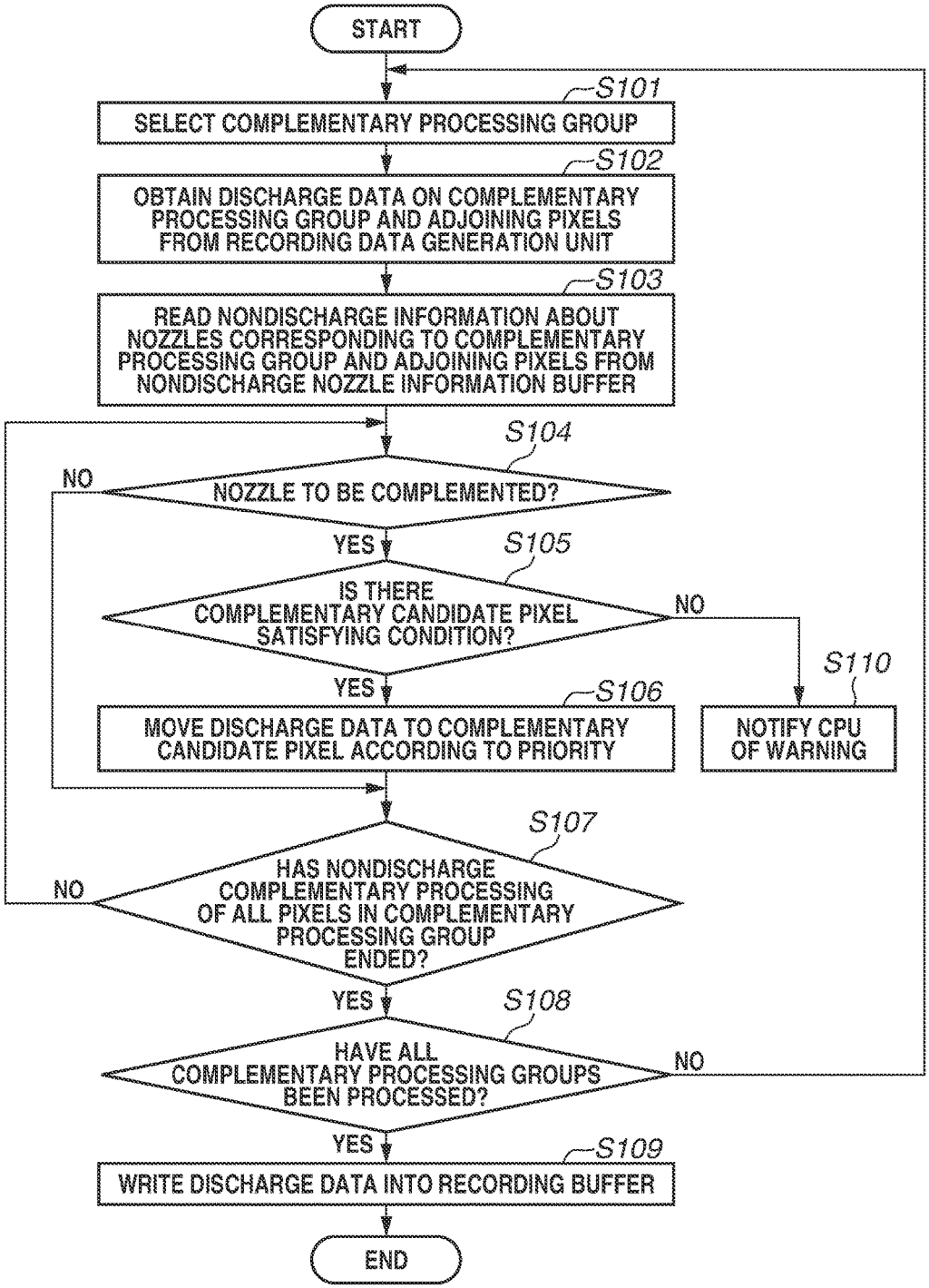
FIG. 4 is a flowchart illustrating nondischarge complementary processing according to the at least one exemplary embodiment of the present disclosure.

FIG. 4 is a flowchart illustrating the nondischarge complementary processing according to the at least one exemplary embodiment of the present disclosure.

The recording data generation unit 207 generates a predetermined amount of discharge data for each nozzle array of each ink color. In step S101, the complementary processing group selectin unit 209 selects a complementary processing group. Specifically, the complementary processing group is selected according to the number of adjoining pixels prohibited from consecutive discharges. The number of adjoining pixels prohibited from consecutive discharges is determined in advance based on discharge constraints of the nozzles of the recording head 105. For example, suppose that the number of adjoining pixels to be prohibited in one direction is two, i.e., a discharge to a pixel adjoining a nozzle to be complemented is prohibited. In such a case, the pixels corresponding to the 16 nozzles are divided into two groups, and the complementary processing group selection unit 209 selects each of the groups.

FIGS. 5A to 5E are diagrams for describing modes of discharge constraints to prohibit consecutive discharges of the recording head 105 according to the present exemplary embodiment. In FIGS. 5A to 5E, the conveyance direction of the sheet illustrated in FIG. 1 will be denoted by X. The nozzle arrangement direction in each nozzle array of the recording head 105 will be denoted by Y. Each pixel is expressed as (Xm, Yn) (m and n are 0, 1, 2, . . . ). In FIGS. 5A to 5E, pieces of discharge data are illustrated to correspond to the nozzles that record the respective pieces. FIGS. 5A to 5E illustrate one nozzle array (array 0). It will be understood that the same applies to the other nozzle arrays. The X direction is a direction orthogonal to the Y direction.

FIG. 5A illustrates a discharge constraint to prohibit a one-pixel consecutive discharge in the X direction. In such a case, as illustrated in FIG. 5A, discharge data is generated so that with respect to a pixel to be processed (X2, Y3), both pixels (X1, Y3) and (X3, Y3) have no discharge data. In the nondischarge complementary processing, pixels (or nozzles) to be complementary candidates are similarly restricted by the foregoing discharge constraint. The discharge constraint in the X direction illustrated in FIG. 5A derives from a constraint on a discharge frequency when a single nozzle discharges ink in a consecutive manner.

FIG. 5B illustrates a discharge constraint to prohibit a one-pixel consecutive discharge in the Y direction. In such a case, as illustrated in FIG. 5B, discharge data is generated so that with respect to the pixel to be processed (X2, Y3), both pixels (X2, Y2) and (X2, Y4) have no discharge data. In the nondischarge complementary processing, pixels (or nozzles) to be complementary candidates are similarly restricted by the foregoing discharge constraint. The discharge constraint in the Y direction can prevent crosstalk between nozzles as described above.

FIG. 5C illustrates a discharge constraint to prohibit a one-pixel consecutive discharge in both the X and Y directions. FIG. 5D illustrates a discharge constraint to prohibit a one-pixel consecutive discharge in the X direction and a two-pixel consecutive discharge in the Y direction. FIG. 5E illustrates a discharge constraint to prohibit a two-pixel conductive discharge in the X direction and a one-pixel consecutive discharge in the Y direction. As described above, the discharge constraints in the X direction depend on the discharge frequency of the nozzles. The lower the discharge frequency of the recording head 105, the greater the number of pixels to prohibit a consecutive discharge. The discharge constraints in the Y direction depend on the degree of crosstalk between nozzles. The conditions of the discharge constraints in the X and Y directions thus vary depending the characteristics of the recording head 105 used. The discharge constraints for the nondischarge complementary processing to be described below are therefore not limited to those illustrated in FIGS. 5A to 5E.

Referring to FIG. 4 again, in step S102, the recording data storage unit 210 receives and stores discharge data on (the pixels of) the complementary processing group selected in step S101 and adjoining pixels from the recording data generation unit 207.

Figure 6A:
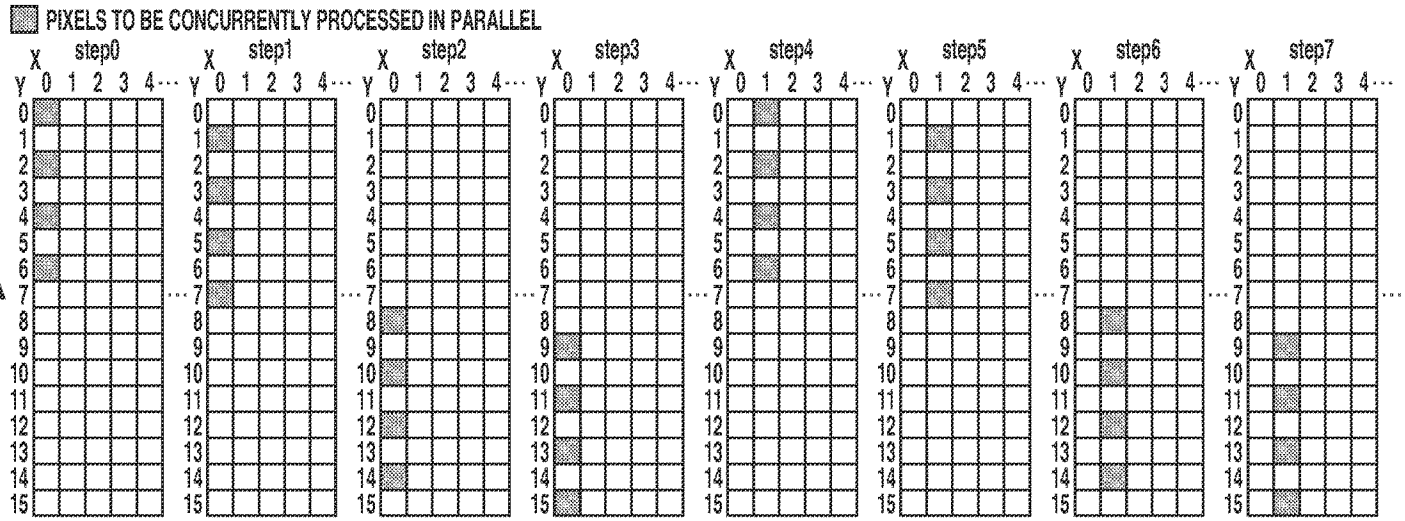
FIGS. 6A and 6B are diagrams for describing two examples of complementary processing groups selected according to the at least one exemplary embodiment of the present disclosure.
Figure 6B:
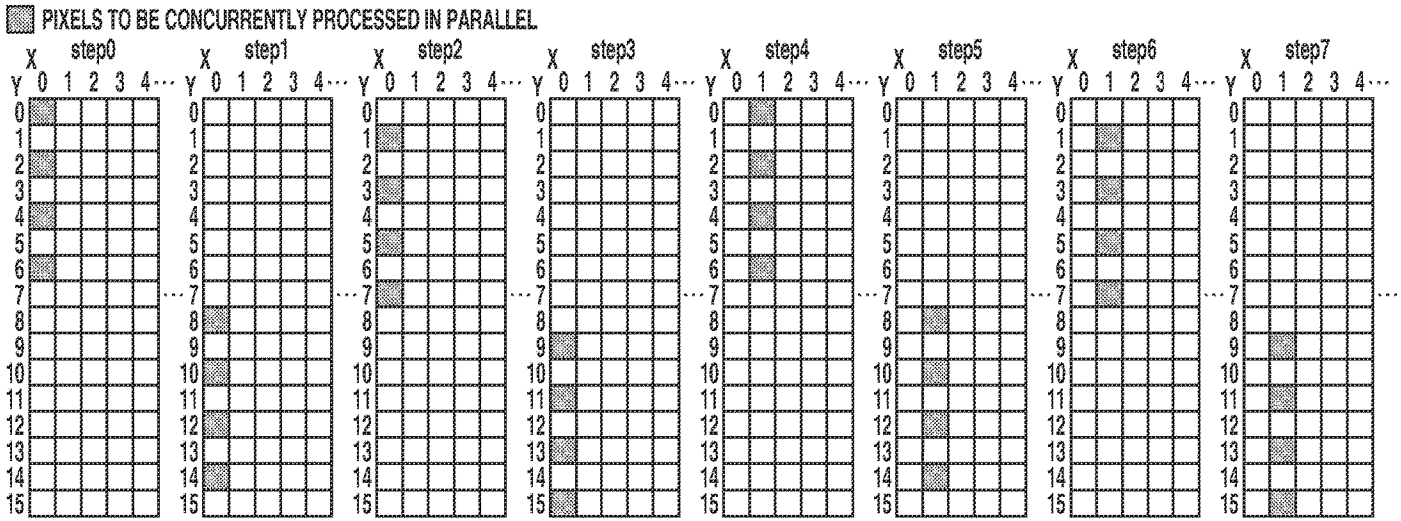

FIGS. 6A and 6B are diagrams for describing two examples of complementary processing groups selected in the at least one exemplary embodiment of the present disclosure. The complementary processing groups are illustrated as data on pixels corresponding to the nozzle array. In FIGS. 6A and 6B, a first complementary processing group (hereinafter, "first group") includes pixels (X, Y) at Y=0, 2, 4, and 6. A second complementary processing group (hereinafter, "second group") includes pixels (X, Y) at Y=1, 3, 5, and 7. In the examples illustrated in FIGS. 6A and 6B, a first complementary processing group (hereinafter, "third group") including pixels (X, Y) at Y=8, 10, 12, and 14, and a second complementary processing group (hereinafter, "fourth group") including pixels (X, Y) at Y=9, 11, 13, and 15 are illustrated as two divided complementary groups selected in step S101. The complementary processing groups are combinations of every other pixel in the Y (nozzle arrangement) direction. Such grouping follows the discharge constraints to prohibit a one-pixel consecutive discharge in the Y direction, illustrated in FIGS. 5B, 5C, and 5D. Of these constraints, the recording heads 105 according to the present exemplary embodiment follow the discharge constraint illustrated in FIG. 5C. In the following description, an example of the nondischarge complementary processing following such a discharge constraint is described. In the X direction, each complementary processing group includes pixels at X=0 to 7. The complementary processing groups have a size (the numbers of pixels in the X and Y directions) according to a priority table to be described below in FIG. 12D. In the data acquisition of step S102, discharge data on one of the foregoing two complementary processing groups and discharge data on pixels adjoining the complementary processing group in the Y direction are obtained. For example, if the complementary processing group is the first group, the adjoin pixels are pixels at Y=1, 3, 5, and 7 (X=0 to 7). The obtained discharge data on the first to fourth groups and the adjoining pixels in the Y direction will be described below in FIG. 10.

FIGS. 6A and 6B illustrate the order of the nondischarge complementary processing on the pixel arrangement. Specifically, as illustrated in FIGS. 6A and 6B, the nondischarge complementary processing is performed on pixels having the same X value in parallel. In each process of the parallel processing, the nondischarge complementary processing is performed in order of the value of Y. In the example illustrated in FIG. 6A, the first to fourth groups of the nondischarge complementary processing are processed in the following manner. In step 0, the nondischarge complementary processing is concurrently performed on four pixels at X0 (which refers to X=0; the same applies hereinafter) and Y0 (which refers to Y=0; the same applies hereinafter), Y2, Y4, and Y6 in the first group. With reference to the processing result, in step 1, the nondischarge complementary processing is concurrently performed on the four pixels at X0 and Y1, Y3, Y5, and Y7 in the second group. In step 2, the nondischarge complementary processing is concurrently performed on the four pixels at X0 and Y8, Y10, Y12, and Y14 in the third group. With reference to the processing result, in step 3, the nondischarge complementary processing is performed on the four pixels at X0 and Y9, Y11, Y13, and Y15 in the fourth group. After the nondischarge complementary processing of one pixel line in the Y direction is completed by the processing of step 3, the nondischarge complementary processing proceeds to the line of X1. The subsequent processing is similarly performed.

In the example illustrated in FIG. 6B, the first to fourth groups of the nondischarge complementary processing are processed in the following manner. In step 0, the nondischarge complementary processing is concurrently performed on the four pixels at X0 and Y0, Y2, Y4, and Y6 in the first group. With reference to the processing result, in step 1, the nondischarge complementary processing is concurrently performed on the four pixels at X0 and Y8, Y10, Y12, and Y14 in the third group. In step 2, the nondischarge complementary processing is concurrently performed on the four pixels at X0 and Y1, Y3, Y5, and Y7 in the second group. With reference to the processing result, in step 3, the nondischarge complementary processing is concurrently performed on the four pixels at X0 and Y9, Y11, Y13, and Y15 in the fourth group.

Referring to FIG. 4 again, in step S103 and subsequent steps, the nondischarge complementary processing on each pixel, described above in FIG. 6A or 6B, is performed by the parallel processing in the Y direction and in order in the X direction. Specifically, in the next step S103, the nondischarge information reading unit 211 reads the nondischarge information about the nozzles corresponding to the foregoing complementary processing group and its adjoining pixels, from the nondischarge information buffer 205, and stores the nondischarge information. FIG. 7A is a diagram illustrating nondischarge information. FIG. 7A illustrates nondischarge information about each nozzle (seg 0 to seg 15) in each of the eight nozzle arrays 0 to 7. For example, the nozzle seg 8 in the nozzle array 0 is illustrated to be a nondischarge nozzle. Such information is stored in association with the pixels represented by the combinations of X0 to X7 and Y0 to Y15.

In step S104, the recording control unit 110 determines whether the nozzle that performs recording on a pixel to be processed is a nondischarge nozzle and to be complemented, based on the stored nondischarge information. If the nozzle is determined to be a nozzle to be complemented (YES in step S104), the processing proceeds to step S105. In step S105, the complementary destination candidate selection unit 212 selects a complementary candidate pixel satisfying the following conditions. That is, a complementary candidate pixel is another pixel having the same Y value (different X value) as that of the nozzle to be complemented, the nozzle performs recording on the pixel is not a defective discharge nozzle, the pixel has no discharge data, and pixels adjoining the pixel in the Y direction have no discharge data. If there is a complement candidate pixel (YES in step S105), the processing proceeds to step S106. In step S106, the complementary processing unit 215 moves the discharge data to the complementary candidate pixel. More specifically, the complementary processing unit 215 assigns the discharge data to the complementary candidate pixel, and deletes the discharge data on the original pixel. If there is a plurality of complementary candidate pixels, the complementary priority determination unit 213 reads priority information from the priority information storage unit 214, and notifies the complementary processing unit 215 of the priority information. The complementary processing unit 215 determines a complementary candidate pixel according to the priority information, and moves the discharge data to that pixel. In step S107, the recording control unit 110 determines whether the nondischarge complementary processing of all the pixels in the complementary processing group has ended. If the nondischarge complementary processing has not ended (NO in step S107), the processing proceeds to step S104. The processing of step S104 and the subsequent steps is then repeated. FIG. 7B is a diagram illustrating the priority information. FIG. 7B illustrates priority information about each nozzle (seg 0 to seg 15) in each of the eight nozzle arrays 0 to 7. In the example illustrated in FIG. 7B, the nozzles seg 0 to seg 7 and the nozzles seg 8 to seg 15 of the nozzle arrays 0 to 7 are respective units, both having the same priority information. It will be understood that the priority information is not limited to the format illustrated in FIG. 7B.

In step S105, if the complementary destination candidate selection unit 212 determines that there is no complementary candidate pixel satisfying the conditions (NO in step S105), the processing proceeds to step S110. In step S110, the complementary destination candidate selection unit 212 notifies a central processing unit (CPU) 216 of the determination (warning). In step S107, if the nondischarge complementary processing of all the pixels in the complementary processing group is determined to have ended (YES in step S107), the processing proceeds to step S108. In step S108, the recording control unit 110 determines whether the foregoing four complementary processing groups have been processed. If all the complementary processing groups have not been processed (NO in step S108), the processing proceeds to step S101. In step S101, four complementary processing groups are then selected as describe above from other rows of pixels at Y0 to Y15 and X8 and later. Similar processing is then performed. If the nondischarge complementary processing of all the complementary processing groups has ended (YES in step S108), the processing proceeds to step S109. In step S109, the nondischarge complementary processing unit 208 writes the processed discharge data into the recording buffer 206.

The foregoing nondischarge complementary processing in the case illustrated in FIG. 5C in which one-pixel consecutive discharges in both the X and Y directions are prohibited will be described below with a specific arrangement of discharge data.

Figure 8:
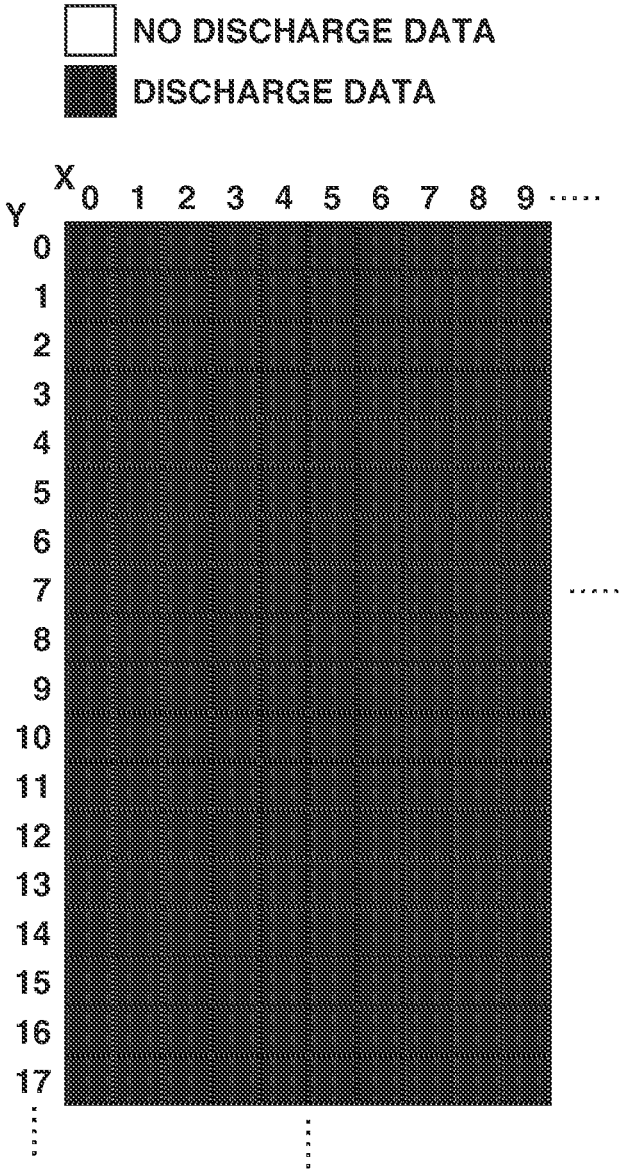
FIG. 8 is a diagram illustrating recording data according to the at least one exemplary embodiment.
Figure 9:
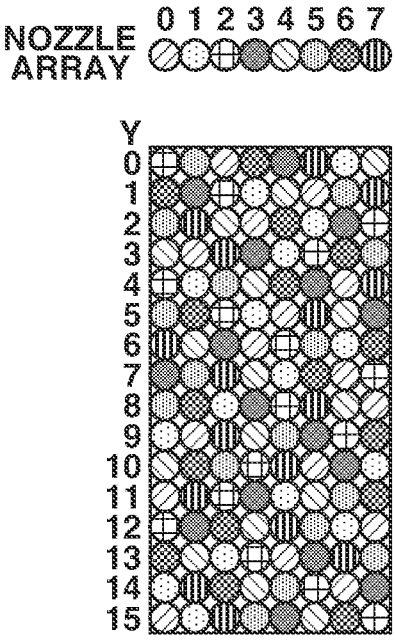
FIG. 9 is a diagram illustrating mask data for generating discharge data corresponding to eight nozzle arrays according to the at least one exemplary embodiment.

Suppose, for example, that the recording data generated by the recording data generation unit 207 is discharge data such that one dot is formed for every pixel as illustrated in FIG. 8. Such discharge data is distributed to and recorded by any of the eight nozzle arrays. FIG. 9 is a diagram illustrating mask data for distributing the pieces of discharge data to (the nozzles of) any of the eight nozzle arrays. As illustrated in FIG. 9, the mask data according to the present exemplary embodiment has a unit size corresponding to the 16 nozzles seg 0 to seg 15 in the Y direction and the eight nozzle arrays 0 to 7 in the X direction. In the present exemplary embodiment, as will be described below, the nondischarge complementary processing is performed on recording data on such a unit of predetermined area. The mask data evenly distributes discharge data to the eight nozzle arrays 0 to 7.

Figure 10:
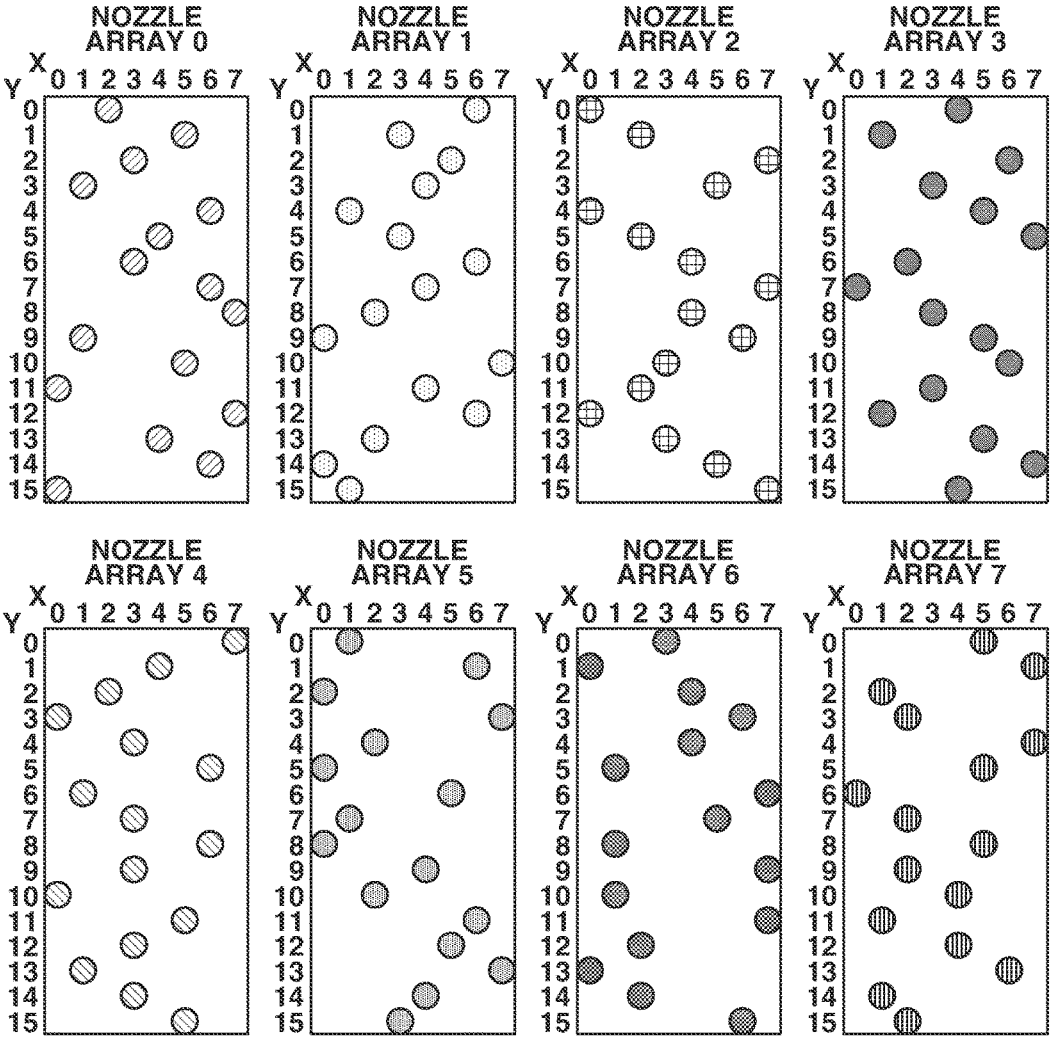
FIG. 10 is a diagram illustrating a result of allocation of the nozzle arrays used for recording to the solid-image discharge data illustrated in FIG. 8 by using the mask data of FIG. 9 from one nozzle array to another.

FIG. 10 is a diagram illustrating the result of allocation of the nozzle arrays used for recording to the solid-image discharge data illustrated in FIG. 8 by using the mask data of FIG. 9 from one nozzle array to another. For example, the nozzle array 0 is allocated to the discharge data (data indicating a discharge "1") on pixels (2, 0), (5, 1), (3, 2), . . . , (6, 14), and (0, 15). As is obvious from FIG. 10, the allocation of the nozzle arrays by the mask data is such that the discharge data (data indicating a discharge "1") is not assigned to adjoining pixels in any of the nozzle arrays.

Figure 11:
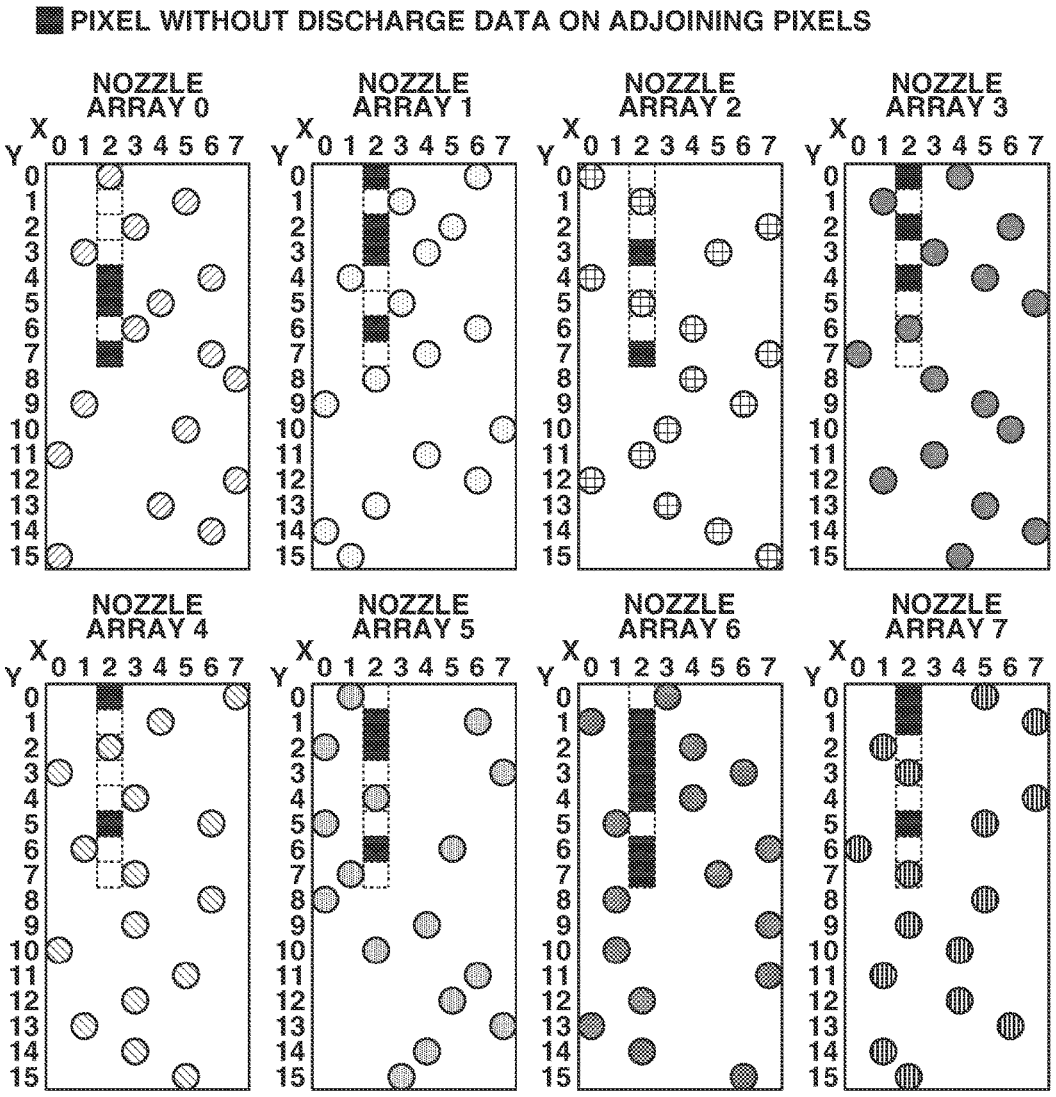
FIG. 11 is a diagram for describing pixels without discharge data on pixels immediately adjoining in a Y direction in the discharge data to which the nozzle arrays illustrated in FIG. 10 are allocated.

FIG. 11 is a diagram for describing pixels without discharge data on pixels immediately adjoining in both the X and Y directions illustrated in FIG. 5C in the discharge data to which the nozzle arrays are allocated as in FIG. 10. FIG. 11 illustrates data to be referred to in the foregoing pixel-by-pixel nondischarge complementary processing in FIG. 4 when the complementary destination candidate selection unit 212 determines, in step S105, whether there is a pixel adjoining a target nozzle. For example, FIG. 11 illustrates pixels without discharge data on pixels immediately adjoining in the X and Y directions among the pixels at X2 and Y0 to Y7 in the respective sets of discharge data of the eight nozzle arrays 0 to 7. For example, FIG. 11 illustrates that the discharge data on the nozzle array 0 has no discharge data on pixels immediately adjoining the pixels at X2 and Y4, Y5, and Y7 in the X and Y directions.

FIGS. 12A to 12E are diagrams for describing the nondischarge complementary processing performed on the nozzle array-allocated discharge data illustrated in FIG. 10, based on the presence or absence of discharge data on adjoining pixels described in FIG. 11. FIGS. 12A to 12E will be described on the assumption that the processing of the discharge data illustrated in FIG. 10 proceeds in the Y direction with the eight pixels (X2, Y0) to (X2, Y7) as a unit.

FIG. 12A illustrates (nozzles of) which of the eight nozzle arrays the recording on the foregoing eight pixels are performed by. FIG. 12B illustrates nondischarge information about the nozzles of the nozzle arrays. FIG. 12C illustrates pixels without discharge data on pixels immediately adjoining in the X and Y directions in the discharge data illustrated in FIG. 12A. FIG. 12C illustrates the pixels without discharge data on adjoining pixels illustrated in FIG. 11, extracted with respect to the respective nozzle arrays. FIG. 12D illustrates a priority information table. If there is a plurality of complementary candidate pixels, a complementary candidate pixel is selected according to the priorities in the descending order of priority.

Conditions of a complementary candidate pixel include that the nozzle corresponding to the pixel is not a nondischarge nozzle, that the pixel has no discharge data, and that adjoining pixels have no discharge data. A pixel satisfying all the conditions is set as a complementary candidate pixel.

FIG. 12E illustrates data obtained by superposing the pieces of data illustrated in FIGS. 12A to 12C. In FIG. 12E, for example, the nozzle seg 1 of the nozzle array 2 is a nondischarge nozzle (FIG. 12B). If the pixel at Y1 corresponding to the nozzle has discharge data, the pixel is a nondischarge complementary target pixel. The discharge data on the nondischarge complementary target pixel is moved to any one of pixels without discharge data on adjoining pixels (the pixel at Y2 of the nozzle array 5 or 6 illustrated in gray in FIG. 12E) by the foregoing nondischarge complementary processing. If there is a plurality of complementary candidate pixels like this example, the priority information table illustrated in FIG. 12D is referred to to select a complementary candidate pixel in the descending order of priority.

Figure 13A:
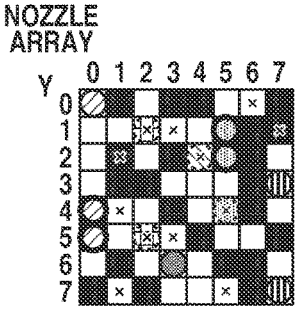
FIGS. 13A, 13B, and 13C are diagrams for describing details of the nondischarge complementary processing according to the at least one exemplary embodiment, including movement of discharge data.
Figure 13B:
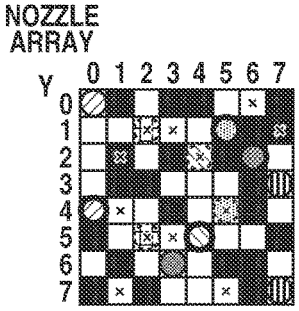
Figure 13C:
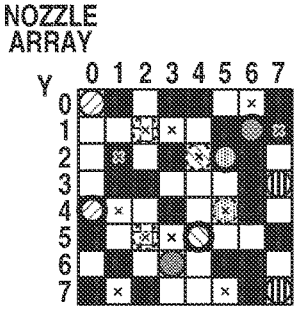

FIGS. 13A to 13C are diagrams for describing details of the nondischarge complementary processing including movement of discharge data according to the present exemplary embodiment. FIG. 13C illustrates the processing of the present exemplary embodiment. FIGS. 13A and 13B illustrate processing of comparative examples.

FIG. 13A illustrates a case in which nondischarge complementary processing is performed on a row of pixels at Y0 to Y7 in parallel. By such processing, the discharge data on the pixel at Y1 of the nozzle array 2 is moved to the pixel at Y1 of the nozzle array 5. The discharge data on the pixel at Y2 of the nozzle array 4 is moved to the pixel at Y2 of the nozzle array 5, without taking account that the resulting pixel adjoins the pixel at Y1 of the nozzle array 5. Pieces of data adjoining in the Y direction are thereby generated. As a result, consecutive discharges from the adjoining nozzles are unavoidable.

FIG. 13B illustrates a case in which the nondischarge complementary processing of a row of pixels at Y0 to Y7 is sequentially performed from Y0 to Y7 pixel by pixel. The nondischarge complementary processing of the pixel at Y1 moves the discharge data on the pixel at Y1 of the nozzle array 2 to the pixel at Y1 of the nozzle 5. The subsequent nondischarge complementary processing of the pixel at Y2 attempts to move the discharge data on the pixel at Y2 of the nozzle array 5 according to the priority, whereas the pixel is not moved since there is discharged data resulting from the nondischarge complementary processing of the pixel at Y1 on the adjoining pixel at Y1 of the nozzle array 5. Instead, the discharge data is moved to the pixel at Y2 of the nozzle 6. Such sequential processing will not generate discharge data on adjoining pixels, but increases processing time.

FIG. 13C illustrates the nondischarge complementary processing according to the present exemplary embodiment. As described above, the pixels are divided between a group 0 including the pixels at Y0, Y2, Y4, and Y6 and a group 1 including the pixels at Y1, Y3, Y5, and Y7. The pixels at Yk (k=0, 2, 4, and 6, or k=1, 3, 5, and 7) in each group are processed in parallel. Specifically, as described above in FIG. 6A, the nondischarge complementary processing of the pixels at Y0, Y2, Y4, and Y6 belonging to the group 0 is initially performed in parallel. By this processing, for example, the discharge data on the nondischarge complementary target pixel at Y2 of the nozzle array 4 is moved to the pixel at Y2 of the nozzle array 5. After such parallel nondischarge complementary processing on the pixels at Yk of the group 0 ends, the parallel nondischarge complementary processing on the pixels at Yk of the group 1 is performed. This processing takes into consideration the result of the previous nondischarge complementary processing of the group 0. For example, the discharge data on the nondischarge complementary target pixel at Y1 of the nozzle array 2 is moved to the pixel at Y1 of the nozzle array 6, not to the pixel at Y1 of the nozzle array 5 which adjoins the discharge data on the pixel at Y2 resulting from the previous nondischarge complementary processing.

As described above, according to the nondischarge complementary processing of the present exemplary embodiment, discharge data can be prevented from lying on adjoining pixels while the nondischarge complementary processing is performed in ¼ the time of the sequential processing illustrated in FIG. 13B.

Complementary candidate pixels in a group processed later become fewer, as compared to ones in a group processed earlier. Such unevenness of complementary candidate pixels sometimes creates issues and sometimes not, depending on conditions such as the discharge amount of the discharge data and the number of nozzle arrays in the recording head 105. If the unevenness needs to be leveled out, the order of processing in units of processing groups can be changed to level out the unevenness of complementary destination candidates, for example, for each page of recording, each plurality of pages of recording, each recording job input to the recording apparatus, or a certain period of time such as each day.

Figure 14:
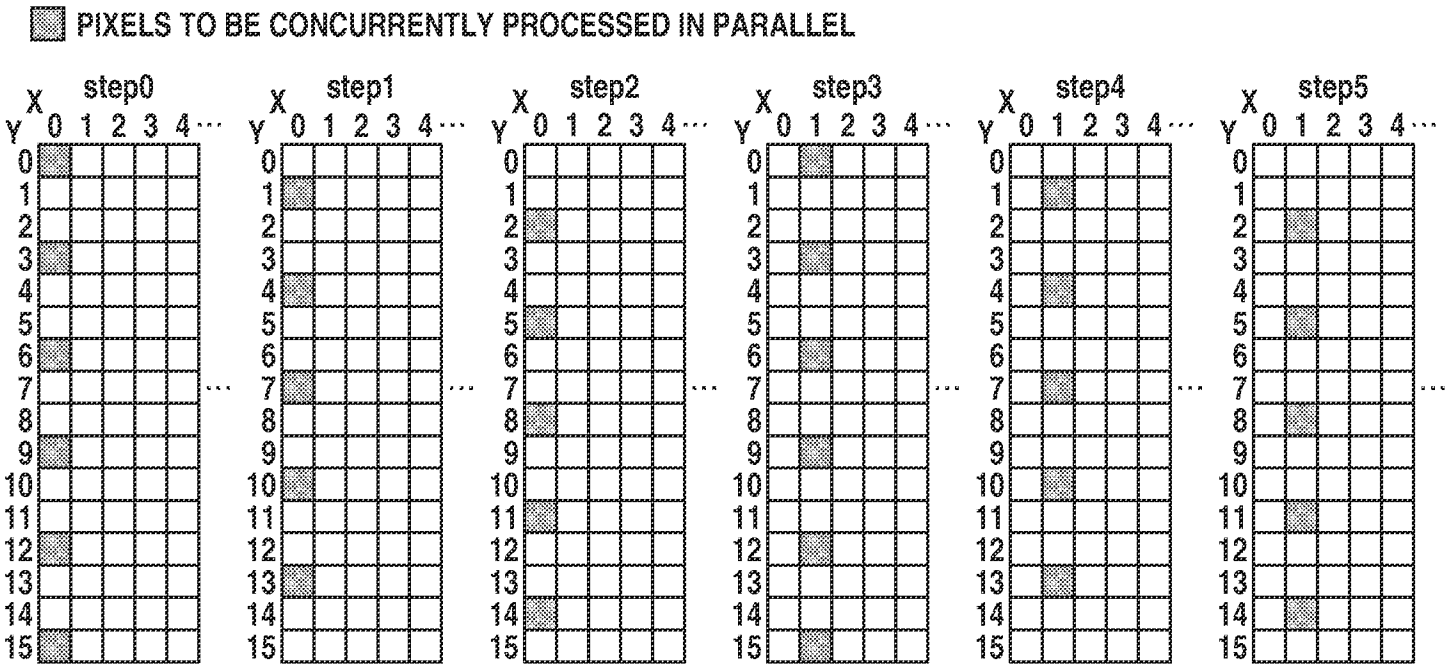
FIG. 14 is a diagram for describing complementary processing groups selected according to another exemplary embodiment of the present disclosure.

As illustrated in FIG. 5D, if a discharge constraint prohibits the existence of discharge data on two consecutive adjoining pixels in the Y direction, processing groups are formed to include every three pixels as illustrated in FIG. 14. In such a case, three processing groups are formed. As with two groups, a plurality of pixels in each of the groups is processed in parallel. Discharge data is prevented from lying on adjoining pixels between groups. Generally speaking, if a discharge constraint prohibits the existence of discharge data on N consecutive adjoining pixels, processing groups are formed to include pixels N pixels apart (every predetermined number of pixels). A plurality of pixels in each group is processed in parallel.

In the foregoing description, the nondischarge complementary processing is described to be performed in the Y direction. It is obvious from the foregoing description that the nondischarge complementary processing can be performed in a similar manner in the X direction.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™, a flash memory device, a memory card, and the like.

In the foregoing exemplary embodiment, the full-line recording heads are described to be used. However, an exemplary embodiment of the present disclosure may be applied to a mode in which a serial recording head is used to perform multi-pass recording in which recording on pixels in a scanning direction are performed by different nozzles in a plurality of times of scanning. For example, in FIG. 10, the recording data on the nozzle arrays 0 to 7 can serve as data to be recorded by a single nozzle array in eight scans 0 to 7, respectively. The foregoing nondischarge complementary processing can be performed on discharge data of such 8-pass multi-pass recording, whereby nondischarge nozzles can be complemented by corresponding recording nozzles in other scans.

As illustrated in FIG. 3, the foregoing nondischarge complementary processing is performed by the recording control unit 110 of the inkjet recording apparatus. However, the nondischarge complementary processing including the generation of the discharge data may be performed by a host apparatus such as a PC. Apparatuses that perform the nondischarge complementary processing, including the host apparatus and the foregoing inkjet recording apparatus, are referred to as "image processing apparatuses".

According to the foregoing configuration, the processing time for nondischarge complementation in generating recording data can be reduced.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-156868, filed Aug. 9, 2016, which is hereby incorporated by reference herein in its entirety.

What is claimed is:

1. An image processing apparatus configured to generate recording data used to discharge ink, by using a recording head including a nozzle array in which a plurality of nozzles configured to discharge the ink is arranged in a predetermined direction, from the recording head to a predetermined area of a recording medium while moving at least either the recording head or the recording medium in a crossing direction crossing the predetermined direction, the image processing apparatus comprising:

a generation unit configured to generate pre-complemented data determining whether to discharge the ink from the nozzle array to each of a plurality of pixel areas on the recording medium;

an obtaining unit configured to obtain information indicating a defective discharge nozzle among the plurality of nozzles; and a complementary unit configured to, if the pre-complemented data determines that the ink is discharged from a target defective discharge nozzle in the nozzle array to a target pixel area on the recording medium, complement a defective discharge of the target defective discharge nozzle by discharging the ink, from a nozzle for complement in the nozzle array which is different than the target defective discharge nozzle, to one of pixel areas ranging from one adjoining the target pixel area on the recording medium in the predetermined direction to one N pixel areas apart from the target pixel area in the predetermined direction, wherein the complementary unit is configured to divide the plurality of pixel areas into N processing groups including pixel areas N pixel areas apart in the predetermined direction, and execute complement processing to determine the one of the pixel areas to complement a defective discharge of a defective discharge nozzle for each of the pixel areas in a processing group of the N processing groups in a parallel manner and execute complement processing for each of the processing group of the N processing groups in a sequential manner from one processing group to another.

2. The image processing apparatus according to claim 1, wherein the generation unit is configured to, if the ink is determined to be discharged to the target pixel area on the recording medium, generate the recording data so that the ink is determined not to be discharged to pixel areas ranging from one adjoining the target pixel area in the predetermined direction to one N pixel areas apart from the target pixel area in the predetermined direction.

3. The image processing apparatus according to claim 1, wherein N is determined according to a degree of crosstalk between nozzles in the nozzle array.

4. The image processing apparatus according to claim 1, wherein the complementary unit is configured to change an order of the complementary processing of the N processing groups.

5. The image processing apparatus according to claim 4, wherein the complementary unit is configured to change the order of the complementary processing of the N processing groups at one of the following timings: every page of the recording medium, every plurality of pages of the recording medium, every job, or every certain period of time.

6. The image processing apparatus according to claim 1, wherein N=1.

7. The image processing apparatus according to claim 1, wherein the complementary unit is configured to, if the pre-complemented data determines that the ink is discharged from the target defective discharge nozzle in the nozzle array to the target pixel area on the recording medium, complement a defective discharge of the target defective discharge nozzle by discharging the ink to any one of pixel areas ranging from one adjoining the target pixel area on the recording medium in the predetermined direction to one N pixel areas apart from the target pixel area in the predetermined direction and pixel areas ranging from one adjoining the target pixel area in the crossing direction to one M pixel areas apart from the target pixel area in the crossing direction.

8. The image processing apparatus according to claim 1, further comprising:

the recording head; and a control unit configured to perform control so that the recording head discharges the ink according to the recording data.

9. An image processing method for generating recording data used to discharge ink, by using a recording head including a nozzle array in which a plurality of nozzles configured to discharge the ink is arranged in a predetermined direction, from the recording head to a predetermined area of a recording medium while moving at least either the recording head or the recording medium in a crossing direction crossing the predetermined direction, the image processing method comprising:

generating pre-complemented data determining whether to discharge the ink from the nozzle array to each of a plurality of pixel areas on the recording medium;

obtaining information indicating a defective discharge nozzle among the plurality of nozzles; and if the pre-complemented data determines that the ink is discharged from a target defective discharge nozzle in the nozzle array to a target pixel area on the recording medium, complementing a defective discharge of the target defective discharge nozzle by discharging the ink, from a nozzle for complement in the nozzle array which is different than the target defective discharge nozzle, to one of pixel areas ranging from one adjoining the target pixel area on the recording medium in the predetermined direction to one N pixel areas apart from the target pixel area in the predetermined direction, wherein the complementing includes dividing the plurality of pixel areas into N processing groups including pixel areas N pixel areas apart in the predetermined direction, and executing complement processing to determine the one of the pixel areas to complement a defective discharge of a defective discharge nozzle for each of the pixel areas in a processing group of the N processing groups in a parallel manner and executing complement processing for each of the processing group of the N processing groups in a sequential manner from one processing group to another.

* * * * *